US007997745B2

(12) United States Patent
Van De Ven et al.

(10) Patent No.: US 7,997,745 B2
(45) Date of Patent: Aug. 16, 2011

(54) LIGHTING DEVICE AND LIGHTING METHOD

(75) Inventors: Antony Paul Van De Ven, Sai Kung (HK); Gerald H. Negley, Durham, NC (US)

(73) Assignee: Cree, Inc., Durham, NC (US)

( * ) Notice: Subject to any disclaimer, the term of this patent is extended or adjusted under 35 U.S.C. 154(b) by 1121 days.

(21) Appl. No.: 11/737,321

(22) Filed: Apr. 19, 2007

(65) Prior Publication Data

US 2007/0278503 A1 Dec. 6, 2007

Related U.S. Application Data

(60) Provisional application No. 60/793,530, filed on Apr. 20, 2006.

(51) Int. Cl.
*F21V 9/16* (2006.01)

(52) U.S. Cl. ..... 362/84; 362/231

(58) Field of Classification Search ..... 362/231, 362/84; 257/89

See application file for complete search history.

(56) References Cited

U.S. PATENT DOCUMENTS

| | | | |
|---|---|---|---|
| 3,805,937 | A | 4/1974 | Hatanaka et al. |
| 3,875,456 | A | 4/1975 | Kano et al. |
| 3,927,290 | A | 12/1975 | Denley |
| 4,120,026 | A | 10/1978 | Tsuchihashi et al. |
| 4,325,146 | A | 4/1982 | Lennington |
| 4,408,157 | A | 10/1983 | Beaubien |
| 4,420,398 | A | 12/1983 | Castino |
| 4,710,699 | A | 12/1987 | Miyamoto |
| 4,772,885 | A | 9/1988 | Uehara et al. |
| 5,087,883 | A | 2/1992 | Hoffman |
| 5,166,815 | A | 11/1992 | Elderfield |
| 5,264,997 | A | 11/1993 | Hutchinsson et al. |
| 5,407,799 | A | 4/1995 | Studier |
| 5,410,519 | A | 4/1995 | Hall et al. |
| 5,477,436 | A | 12/1995 | Betling et al. |
| 5,563,849 | A | 10/1996 | Hall et al. |
| 5,803,579 | A | 9/1998 | Turnbull et al. |
| 5,851,063 | A | 12/1998 | Doughty et al. |

(Continued)

FOREIGN PATENT DOCUMENTS

DE 3 916 875 12/1990

(Continued)

OTHER PUBLICATIONS

White Light LED, Part Nos. NSPW300BS and NSPW312BS, High Brightness LEDs, Nov. 12, 1999, Publisher: Nichia Corporation.

(Continued)

*Primary Examiner* — Sharon E Payne
(74) *Attorney, Agent, or Firm* — Burr & Brown

(57) ABSTRACT

A lighting device, comprising a first group of solid state light emitters and a first group of lumiphors, wherein at least some of the first group of solid state light emitters are contained in a first group of packages, each of which also comprises at least one of the first group of lumiphors. If all of the first group of solid state light emitters which are contained in the first group of packages are illuminated and/or if current is supplied to a power line, (1) a combined illumination from the first group of packages would, in the absence of any additional light, have color coordinates on a 1976 CIE Chromaticity Diagram which define a first point, and (2) at least 20% of the packages would emit light having color coordinates spaced from the first point. Also, methods of lighting.

53 Claims, 4 Drawing Sheets

U.S. PATENT DOCUMENTS

| | | | |
|---|---|---|---|
| 5,959,316 | A | 9/1999 | Lowery |
| 6,066,861 | A | 5/2000 | Hohn et al. |
| 6,076,936 | A | 6/2000 | George |
| 6,084,250 | A | 7/2000 | Justel et al. |
| 6,095,666 | A | 8/2000 | Salam |
| 6,132,072 | A | 10/2000 | Turnbull et al. |
| 6,212,213 | B1 | 4/2001 | Weber et al. |
| 6,234,648 | B1 | 5/2001 | Borner et al. |
| 6,252,254 | B1 | 6/2001 | Soules |
| 6,255,670 | B1 | 7/2001 | Srivastava et al. |
| 6,278,135 | B1 | 8/2001 | Srivastava et al. |
| 6,292,901 | B1 | 9/2001 | Lys et al. |
| 6,294,800 | B1 | 9/2001 | Duggal et al. |
| 6,319,425 | B1 | 11/2001 | Tasaki et al. |
| 6,335,538 | B1 | 1/2002 | Prutchi et al. |
| 6,337,536 | B1 | 1/2002 | Matsubara et al. |
| 6,348,766 | B1 | 2/2002 | Ohishi et al. |
| 6,350,041 | B1 | 2/2002 | Tarsa et al. |
| 6,357,889 | B1 | 3/2002 | Duggal et al. |
| 6,394,621 | B1 | 5/2002 | Hanewinkel |
| 6,429,583 | B1 | 8/2002 | Levinson et al. |
| 6,441,558 | B1 | 8/2002 | Muthu et al. |
| 6,480,299 | B1 | 11/2002 | Drakopoulos et al. |
| 6,501,100 | B1 | 12/2002 | Srivastava et al. |
| 6,504,179 | B1 | 1/2003 | Ellens et al. |
| 6,513,949 | B1 | 2/2003 | Marshall et al. |
| 6,522,065 | B1 | 2/2003 | Srivastava et al. |
| 6,538,371 | B1 | 3/2003 | Duggal et al. |
| 6,550,949 | B1 | 4/2003 | Bauer et al. |
| 6,552,495 | B1 | 4/2003 | Chang |
| 6,577,073 | B2 | 6/2003 | Shimizu et al. |
| 6,578,986 | B2 | 6/2003 | Swaris et al. |
| 6,592,810 | B2 | 7/2003 | Nishida et al. |
| 6,600,175 | B1 | 7/2003 | Baretz et al. |
| 6,600,324 | B2 | 7/2003 | St-Germain |
| 6,603,258 | B1 | 8/2003 | Mueller-Mach et al. |
| 6,608,485 | B2 | 8/2003 | St-Germain |
| 6,616,862 | B2 | 9/2003 | Srivastava et al. |
| 6,624,350 | B2 | 9/2003 | Nixon et al. |
| 6,636,003 | B2 | 10/2003 | Rahm et al. |
| 6,642,666 | B1 | 11/2003 | St-Germain |
| 6,685,852 | B2 | 2/2004 | Setlur et al. |
| 6,686,691 | B1 | 2/2004 | Mueller et al. |
| 6,692,136 | B2 | 2/2004 | Marshall et al. |
| 6,703,173 | B2 | 3/2004 | Lu et al. |
| 6,712,486 | B1 | 3/2004 | Popovich et al. |
| 6,737,801 | B2 | 5/2004 | Ragle |
| 6,744,194 | B2 | 6/2004 | Fukasawa et al. |
| 6,762,563 | B2 | 7/2004 | St-Germain |
| 6,784,463 | B2 | 8/2004 | Camras et al. |
| 6,791,257 | B1 | 9/2004 | Sato et al. |
| 6,817,735 | B2 | 11/2004 | Shimizu et al. |
| 6,841,804 | B1 | 1/2005 | Lung-Chien et al. |
| 6,851,834 | B2 | 2/2005 | Leysath |
| 6,880,954 | B2 | 4/2005 | Ollet et al. |
| 6,882,101 | B2 | 4/2005 | Ragle |
| 6,914,267 | B2 | 7/2005 | Fukasawa et al. |
| 6,936,857 | B2 | 8/2005 | Doxsee et al. |
| 6,967,116 | B2 | 11/2005 | Negley |
| 6,980,176 | B2 | 12/2005 | Matsumoto et al. |
| 7,005,679 | B2 | 2/2006 | Tarsa et al. |
| 7,008,078 | B2 | 3/2006 | Shimizu et al. |
| 7,009,343 | B2 | 3/2006 | Lim et al. |
| 7,014,336 | B1 | 3/2006 | Ducharme et al. |
| 7,023,019 | B2 | 4/2006 | Maeda et al. |
| 7,061,454 | B2 | 6/2006 | Sasuga et al. |
| 7,066,623 | B2 | 6/2006 | Lee et al. |
| 7,083,302 | B2 | 8/2006 | Chen et al. |
| 7,093,958 | B2 | 8/2006 | Coushaine |
| 7,095,056 | B2 | 8/2006 | Vitta et al. |
| 7,102,172 | B2 | 9/2006 | Lynch et al. |
| 7,116,308 | B1 | 10/2006 | Heeks et al. |
| 7,118,262 | B2 | 10/2006 | Negley et al. |
| 7,125,143 | B2 | 10/2006 | Hacker |
| 7,135,664 | B2 | 11/2006 | Vornsand et al. |
| 7,164,231 | B2 | 1/2007 | Choi et al. |
| 7,207,691 | B2 | 4/2007 | Lee et al. |
| 7,213,940 | B1 | 5/2007 | Van De Ven et al. |
| 7,215,074 | B2 | 5/2007 | Shimizu et al. |
| 7,232,212 | B2 | 6/2007 | Iwase |
| 7,239,085 | B2 | 7/2007 | Kawamura |
| 7,250,715 | B2 | 7/2007 | Meuller et al. |
| 7,255,457 | B2 | 8/2007 | Ducharme et al. |
| 7,256,557 | B2 | 8/2007 | Lim |
| 7,322,732 | B2 | 1/2008 | Negley et al. |
| 7,329,024 | B2 | 2/2008 | Lynch et al. |
| 7,358,954 | B2 | 4/2008 | Negley |
| 7,365,485 | B2 | 4/2008 | Fukasawa et al. |
| 7,387,405 | B2 | 6/2008 | Ducharme et al. |
| 7,422,504 | B2 | 9/2008 | Maeda et al. |
| 7,453,195 | B2 | 11/2008 | Radkov |
| 7,474,044 | B2 | 1/2009 | Ge |
| 2001/0002049 | A1 | 5/2001 | Reeh et al. |
| 2002/0006044 | A1 | 1/2002 | Harbers et al. |
| 2002/0070681 | A1 | 6/2002 | Shimizu et al. |
| 2002/0087532 | A1 | 7/2002 | Barritz et al. |
| 2002/0149576 | A1 | 10/2002 | Tanaka et al. |
| 2003/0026096 | A1 | 2/2003 | Ellens et al. |
| 2003/0030063 | A1 | 2/2003 | Sosniak |
| 2003/0067773 | A1 | 4/2003 | Marshall et al. |
| 2003/0146411 | A1 | 8/2003 | Srivastava et al. |
| 2003/0222268 | A1 | 12/2003 | Yocom et al. |
| 2004/0046178 | A1 | 3/2004 | Sano |
| 2004/0105264 | A1 | 6/2004 | Spero |
| 2004/0212998 | A1 | 10/2004 | Mohacsi |
| 2004/0217364 | A1 | 11/2004 | Tarsa et al. |
| 2004/0218387 | A1 | 11/2004 | Gerlach |
| 2004/0218388 | A1 | 11/2004 | Suzuki |
| 2004/0239839 | A1 | 12/2004 | Hong |
| 2004/0264193 | A1 | 12/2004 | Okumura |
| 2004/0264212 | A1 | 12/2004 | Chung et al. |
| 2005/0007306 | A1 | 1/2005 | Iisaka et al. |
| 2005/0052378 | A1 | 3/2005 | Hacker |
| 2005/0190141 | A1 | 9/2005 | Roth et al. |
| 2005/0231976 | A1 | 10/2005 | Keuper et al. |
| 2005/0243556 | A1 | 11/2005 | Lynch |
| 2005/0251698 | A1 | 11/2005 | Lynch et al. |
| 2005/0259423 | A1 | 11/2005 | Heuser et al. |
| 2005/0274972 | A1 | 12/2005 | Roth et al. |
| 2006/0012989 | A1 | 1/2006 | Lee |
| 2006/0022582 | A1 | 2/2006 | Radkov |
| 2006/0060872 | A1 | 3/2006 | Edmond et al. |
| 2006/0067073 | A1 | 3/2006 | Ting |
| 2006/0105482 | A1 | 5/2006 | Alferink et al. |
| 2006/0113548 | A1 | 6/2006 | Chen et al. |
| 2006/0138435 | A1 | 6/2006 | Tarsa et al. |
| 2006/0138937 | A1 | 6/2006 | Ibbetson |
| 2006/0152140 | A1 | 7/2006 | Brandes |
| 2006/0152172 | A9 | 7/2006 | Mueller et al. |
| 2006/0180818 | A1 | 8/2006 | Nagai et al. |
| 2006/0181192 | A1 | 8/2006 | Radkov |
| 2006/0245184 | A1 | 11/2006 | Galli |
| 2007/0001188 | A1 | 1/2007 | Lee |
| 2007/0001994 | A1 | 1/2007 | Roth |
| 2007/0041220 | A1 | 2/2007 | Lynch |
| 2007/0051966 | A1 | 3/2007 | Higashi et al. |
| 2007/0090381 | A1 | 4/2007 | Otsuka et al. |
| 2007/0137074 | A1 | 6/2007 | Van De Ven et al. |
| 2007/0139920 | A1 | 6/2007 | Van De Ven et al. |
| 2007/0139923 | A1 | 6/2007 | Negley |
| 2007/0170447 | A1 | 7/2007 | Negley |
| 2007/0171145 | A1 | 7/2007 | Coleman et al. |
| 2007/0202623 | A1 | 8/2007 | Gao |
| 2007/0223219 | A1 | 9/2007 | Medendorp et al. |
| 2007/0236911 | A1 | 10/2007 | Negley |
| 2007/0247414 | A1 | 10/2007 | Robert |
| 2007/0247847 | A1 | 10/2007 | Villard |
| 2007/0262337 | A1 | 11/2007 | Villard |
| 2007/0263393 | A1 | 11/2007 | Van De Ven et al. |
| 2007/0267983 | A1 | 11/2007 | Van De Ven et al. |
| 2007/0274063 | A1 | 11/2007 | Negley |
| 2007/0274080 | A1 | 11/2007 | Negley et al. |
| 2007/0276606 | A1 | 11/2007 | Radkov |
| 2007/0278503 | A1 | 12/2007 | Van De Ven et al. |
| 2007/0278934 | A1 | 12/2007 | Van De Ven et al. |
| 2007/0278974 | A1 | 12/2007 | Van De Ven |
| 2007/0279440 | A1 | 12/2007 | Negley |

| | | | |
|---|---|---|---|
| 2007/0279903 | A1 | 12/2007 | Negley et al. |
| 2007/0280624 | A1 | 12/2007 | Negley et al. |
| 2008/0084685 | A1 | 4/2008 | Van De Ven |
| 2008/0084700 | A1 | 4/2008 | Van De Ven |
| 2008/0084701 | A1 | 4/2008 | Van De Ven et al. |
| 2008/0088248 | A1 | 4/2008 | Myers |
| 2008/0089053 | A1 | 4/2008 | Negley |
| 2008/0106895 | A1 | 5/2008 | Van De Ven |
| 2008/0106907 | A1 | 5/2008 | Trott et al. |
| 2008/0112168 | A1 | 5/2008 | Pickard et al. |
| 2008/0112170 | A1 | 5/2008 | Trott et al. |
| 2008/0112183 | A1 | 5/2008 | Negley |
| 2008/0130265 | A1 | 6/2008 | Negley |
| 2008/0130285 | A1 | 6/2008 | Negley |
| 2008/0136313 | A1 | 6/2008 | Negley et al. |
| 2008/0137347 | A1 | 6/2008 | Trott et al. |
| 2008/0170396 | A1 | 7/2008 | Yuan et al. |
| 2008/0179602 | A1 | 7/2008 | Negley |
| 2008/0192462 | A1 | 8/2008 | Steedly et al. |
| 2008/0192493 | A1 | 8/2008 | Villard |
| 2008/0211416 | A1 | 9/2008 | Negley et al. |
| 2008/0231201 | A1 | 9/2008 | Higley et al. |
| 2008/0259589 | A1 | 10/2008 | Van De Ven et al. |
| 2008/0278928 | A1 | 11/2008 | Van De Ven et al. |
| 2008/0278940 | A1 | 11/2008 | Van De Ven et al. |
| 2008/0278950 | A1 | 11/2008 | Pickard et al. |
| 2008/0278952 | A1 | 11/2008 | Trott et al. |
| 2008/0304260 | A1 | 12/2008 | Van De Ven et al. |
| 2008/0304261 | A1 | 12/2008 | Van De Ven et al. |
| 2008/0304269 | A1 | 12/2008 | Pickard et al. |
| 2008/0309255 | A1 | 12/2008 | Myers |
| 2008/0310154 | A1 | 12/2008 | Van De Ven et al. |
| 2009/0002986 | A1 | 1/2009 | Medendorp et al. |

FOREIGN PATENT DOCUMENTS

| | | |
|---|---|---|
| DE | 3916875 | 12/1990 |
| DE | 10-335077 | 3/2005 |
| EP | 0 838 866 | 4/1998 |
| EP | 0 971 421 | 1/2000 |
| EP | 1 024 399 | 8/2000 |
| EP | 1 081 771 | 3/2001 |
| EP | 1 160 883 | 12/2001 |
| EP | 1 193 772 | 4/2002 |
| EP | 1 367 655 | 12/2003 |
| EP | 1 380 876 | 1/2004 |
| EP | 1 462 711 | 12/2004 |
| EP | 1 566 848 | 8/2005 |
| EP | 1 571 715 | 9/2005 |
| EP | 1 760 795 | 1/2006 |
| JP | 04-159519 | 6/1992 |
| JP | 09-146089 | 6/1997 |
| JP | 10-163535 | 6/1998 |
| JP | 2000-022222 | 1/2000 |
| JP | 2000-183408 | 6/2000 |
| JP | 2001-111114 | 4/2001 |
| JP | 2001-156331 | 6/2001 |
| JP | 2001-307506 | 11/2001 |
| JP | 2002-150821 | 5/2002 |
| JP | 2003-515956 | 5/2003 |
| JP | 2004-080046 | 3/2004 |
| JP | 2004-103443 | 4/2004 |
| JP | 2004-253309 | 9/2004 |
| JP | 2004-356116 | 12/2004 |
| JP | 2004-363055 | 12/2004 |
| JP | 2005-005482 | 1/2005 |
| JP | 2005-101296 | 4/2005 |
| JP | 2005-142311 | 6/2005 |
| JP | 2007-122950 | 5/2007 |
| JP | 2007-141737 | 6/2007 |
| TW | 546854 | 8/2003 |
| WO | 98/43014 | 10/1998 |
| WO | 99/66483 | 12/1999 |
| WO | 00/34709 | 6/2000 |
| WO | 01/41215 | 6/2001 |
| WO | 01/43113 | 6/2001 |
| WO | 01/69692 | 9/2001 |
| WO | 03/056876 | 7/2003 |
| WO | 03/091771 | 11/2003 |
| WO | 2004/068909 | 8/2004 |
| WO | 2005/004202 | 1/2005 |
| WO | 2005013365 | 2/2005 |
| WO | 2005/013365 | 10/2005 |
| WO | 2005/124877 | 12/2005 |
| WO | 2005124877 | 12/2005 |
| WO | 2006/028312 | 3/2006 |
| WO | 2007/061758 | 5/2007 |

OTHER PUBLICATIONS

Chhajed, S., *Influence of junction temperature on chromaticity and color-rendering properties of trichromatic white-light sources . . .*, Journal of Applied Physics, 2005, vol. 97pp. 1-8.

Color Kinetics Inc., Color Kinetics Support : White Papers & Presentations; available at http://www.colorkinetics.com/support/whitepapers/:, Solid State Lighting White Papers & Presentations, Feb. 22, 2006, pp. 1-4.

Color Kinetics Inc., *Color Quality of Intelligent Solid-State Light Systems*, Color Quality of Solid-State Light Sources, Mar. 2005, pp. 1-3.

Compound Semiconductors Online, "LED Lighting Fixtures, Inc. Sets World Record at 80 Lumens per Watt for Warm White", Compound Semiconductors Online, May 30, 2006, pp. 1.

Cree, Inc., "Cree® Xlamp® 7090 XR-E Series LED Binning and Labeling," Application Note: CLD-AP08.000, 7pp (2006).

CSA International, "Test Data Report," Project No. 1786317, Report No. 1786317-1 (Apr. 2006).

DOE SSL CALiPer Report, "Product Test Reference: CALiPER 07-31 Downlight Lamp".

DOE SSL CALiPer Report, "Product Test Reference: CALiPER 07-47 Downlight Lamp".

Krames et al., *Lumileds Lighting, Light from Silicon Valley*, Progress and Future Direction of LED Technology, SSL Workshop, Nov. 13, 2003, Publisher: Limileds Lighting Inc., pp. 1-21.

Narendran et al., "Solid State lighting: failure analysis of white LEDs," Journal of Cystal Growth, vol. 268, Issues 1-4, Aug. 2004, Abstract.

Narendran et al., *Color Rendering Properties of LED Light Sources*, 2002, pp. 1-8.

Nichia, White Light LED, Part Nos. NSPW300BS and NSPW312BS, High Brightness LEDs, Nov. 12, 1999, Publisher: Nichia Corporation.

Press Release from LED Lighting Fixtures dated Apr. 24, 2006 entitled "LED Lighting Fixtures, Inc. achieves unprecedented gain in light output from new luminaire".

Press Release from LED Lighting Fixtures dated Feb. 16, 2006 entitled "LED Lighting Fixtures, Inc. Announces Record Performance".

Press Release from LED Lighting Fixtures dated Feb. 7, 2007 entitled "LED Lighting Fixtures Announces its first LED-based Recessed Down Light".

Press Release from LED Lighting Fixtures dated Jan. 26, 2006 entitled "LED Lighting Fixtures Creates 750 Lumen Recessed Light and Uses Only 16 Watts of Power".

Press Release from LED Lighting Fixtures dated May 30, 2006 entitled "LED Lighting Fixtures, Inc. Sets World Record at 80 Lumens per Watt for Warm White Fixture".

Press Release from LED Lighting Fixtures dated Nov. 28, 2007 entitled "New Lamp from LED Lighting Fixtures Shatter World Record for Energy Efficiency".

Shimizu, "Development of High-Efficiency LED Downlight", First International Conference on White LEDs and Solid State Lighting, Nov. 30, 2007.

U.S. Department of Energy, "DOE Solid-State Lighting CALiPER Program, Summary of Results: Round 3 of Product Testing," Oct. 2007.

U.S. Department of Energy, "DOE Solid-State Lighting CALiPER Program, Summary of Results: Round 4 of Product Testing," Jan. 2008.

U.S. Department of Energy, "DOE Solid-State Lighting CALiPER Program, Summary of Results: Round 5 of Product Testing," May 2008.

Van De Ven et al., "Warm White Illumination with High CRI and High Efficacy by Combining 455 nm Excited Yellowish Phosphor LEDs and Red A1InGaP LEDs," First International Conference on White LEDs and Solid State Lighting, Nov. 30, 2007.
CSA International, "Test Data Report," Project No. 1786317, Report No. 1786317-1 (Apr. 2006).
Optoled Lighting Inc., *OptoLED Product Information*, 2009, Publisher: OptoLED GmBH website: accessed at http://222.optoled.de/englisch/products/led.html.
Permlight Inc., *Enbryten LED Product Information*, Feb. 2005, Publisher: Permlight Inc. website; accessed at http://www.webarchive.org displaying that www.permlight.com/products/LEDfixtures.asp was publicly available Jan. 2004.
U.S. Appl. No. 11/613,692, filed Dec. 20, 2006.
U.S. Appl. No. 11/614,180, filed Dec. 21, 2006.
U.S. Appl. No. 11/624,811, filed Jan. 19, 2007.
U.S. Appl. No. 11/626,483, filed Jan. 24, 2007.
U.S. Appl. No. 11/736,799, filed Apr. 18, 2007.
U.S. Appl. No. 11/951,626, filed Dec. 6, 2007.
U.S. Appl. No. 12/057,748, filed Mar. 28, 2008.
U.S. Appl. No. 11/743,324, filed May 2, 2007.
U.S. Appl. No. 11/032,363, filed Jan. 10, 2005.
U.S. Appl. No. 61/075,513, filed Jun. 25, 2008.

LIGHTING DEVICE AND LIGHTING METHOD

CROSS-REFERENCE TO RELATED APPLICATIONS

This application claims the benefit of U.S. Provisional Patent Application No. 60/793,530, filed on Apr. 20, 2006, entitled "LIGHTING DEVICE AND LIGHTING METHOD" (inventors: Gerald H. Negley and Antony Paul van de Ven), the entirety of which is hereby incorporated by reference.

FIELD OF THE INVENTION

The present invention relates to a lighting device, in particular, a device which includes one or more solid state light emitters and which may optionally also include one or more luminescent materials (e.g., one or more phosphors). The present invention is also directed to lighting methods.

BACKGROUND OF THE INVENTION

A large proportion (some estimates are as high as twenty-five percent) of the electricity generated in the United States each year goes to lighting. Accordingly, there is an ongoing need to provide lighting which is more energy-efficient. It is well-known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient as compared to solid state light emitters, such as light emitting diodes.

In addition, as compared to the normal lifetimes of solid state light emitters, incandescent light bulbs have relatively short lifetimes, i.e., typically about 750-1000 hours. In comparison, light emitting diodes, for example, have lifetimes between 50,000 and 70,000 hours. Fluorescent bulbs have longer lifetimes (e.g., 10,000-20,000 hours) than incandescent lights, but provide less favorable color reproduction.

Color reproduction is typically measured using the Color Rendering Index (CRI Ra). CRI Ra is a modified average of the relative measurements of how the color rendition of an illumination system compares to that of a reference radiator when illuminating eight reference colors, i.e., it is a relative measure of the shift in surface color of an object when lit by a particular lamp. The CRI Ra equals 100 if the color coordinates of a set of test colors being illuminated by the illumination system are the same as the coordinates of the same test colors being irradiated by the reference radiator. Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways—driver response time, however, significantly decreases with lower CRI values (for any given brightness, legibility decreases with lower CRI).

Another issue faced by conventional light fixtures is the need to periodically replace the lighting devices (e.g., light bulbs, etc.). Such issues are particularly pronounced where access is difficult (e.g., vaulted ceilings, bridges, high buildings, traffic tunnels) and/or where change-out costs are extremely high. The typical lifetime of conventional fixtures is about 20 years, corresponding to a light-producing device usage of at least about 44,000 hours (based on usage of 6 hours per day for 20 years). Light-producing device lifetime is typically much shorter, thus creating the need for periodic change-outs.

Accordingly, for these and other reasons, efforts have been ongoing to develop ways by which solid state light emitters can be used in place of incandescent lights, fluorescent lights and other light-generating devices in a wide variety of applications. In addition, where solid state light emitters are already being used, efforts are ongoing to provide solid state light emitters which are improved, e.g., with respect to energy efficiency, color rendering index (CRI Ra), contrast, efficacy (lm/W), and/or duration of service.

Light emitting diodes are well-known semiconductor devices that convert electrical current into light. A wide variety of light emitting diodes are used in increasingly diverse fields for an ever-expanding range of purposes.

More specifically, light emitting diodes are semiconducting devices that emit light (ultraviolet, visible, or infrared) when a potential difference is applied across a p-n junction structure. There are a number of well-known ways to make light emitting diodes and many associated structures, and the present invention can employ any such devices. By way of example, Chapters 12-14 of Sze, Physics of Semiconductor Devices, (2d Ed. 1981) and Chapter 7 of Sze, Modern Semiconductor Device Physics (1998) describe a variety of photonic devices, including light emitting diodes.

The commonly recognized and commercially available light emitting diode ("LED") that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

As is well-known, a light emitting diode produces light by exciting electrons across the band gap between a conduction band and a valence band of a semiconductor active (light-emitting) layer. The electron transition generates light at a wavelength that depends on the band gap. Thus, the color of the light (wavelength) emitted by a light emitting diode depends on the semiconductor materials of the active layers of the light emitting diode.

Although the development of light emitting diodes has in many ways revolutionized the lighting industry, some of the characteristics of light emitting diodes have presented challenges, some of which have not yet been fully met. For example, the emission spectrum of any particular light emitting diode is typically concentrated around a single wavelength (as dictated by the light emitting diode's composition and structure), which is desirable for some applications, but not desirable for others, (e.g., for providing lighting, such an emission spectrum provides a very low CRI).

Because light that is perceived as white is necessarily a blend of light of two or more colors (or wavelengths), no single light emitting diode junction has been developed that can produce white light. "White" light emitting diode lamps have been produced which have a light emitting diode pixel formed of respective red, green and blue light emitting diodes. Other "white" light emitting diodes have been produced which include (1) a light emitting diode which generates blue light and (2) a luminescent material (e.g., a phosphor) that emits yellow light in response to excitation by light emitted by the light emitting diode, whereby the blue light and the yellow light, when mixed, produce light that is perceived as white light.

In addition, the blending of primary colors to produce combinations of non-primary colors is generally well understood in this and other arts. In general, the 1931 CIE Chromaticity Diagram (an international standard for primary colors established in 1931), and the 1976 CIE Chromaticity Diagram (similar to the 1931 Diagram but modified such that similar distances on the Diagram represent similar perceived differences in color) provide useful reference for defining colors as weighted sums of primary colors.

Light emitting diodes can thus be used individually or in any combinations, optionally together with one or more luminescent material (e.g., phosphors or scintillators) and/or filters, to generate light of any desired perceived color (including white). Accordingly, the areas in which efforts are being made to replace existing light sources with light emitting diode light sources, e.g., to improve energy efficiency, color rendering index (CRI), efficacy (lm/W), and/or duration of service, are not limited to any particular color or color blends of light.

A wide variety of luminescent materials (also known as lumiphors or luminophoric media, e.g., as disclosed in U.S. Pat. No. 6,600,175, the entirety of which is hereby incorporated by reference) are well-known and available to persons of skill in the art. For example, a phosphor is a luminescent material that emits a responsive radiation (e.g., visible light) when excited by a source of exciting radiation. In many instances, the responsive radiation has a wavelength which is different from the wavelength of the exciting radiation. Other examples of luminescent materials include scintillators, day glow tapes and inks which glow in the visible spectrum upon illumination with ultraviolet light.

Luminescent materials can be categorized as being down-converting, i.e., a material which converts photons to a lower energy level (longer wavelength) or up-converting, i.e., a material which converts photons to a higher energy level (shorter wavelength).

Inclusion of luminescent materials in LED devices has been accomplished by adding the luminescent materials to a clear or transparent encapsulant material (e.g., epoxy-based, silicone-based or glass-based material) as discussed above, for example by a blending or coating process.

For example, U.S. Pat. No. 6,963,166 (Yano '166) discloses that a conventional light emitting diode lamp includes a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion, which is further encapsulated with a second resin portion. According to Yano '166, the first resin portion is obtained by filling the cup reflector with a resin material and curing it after the light emitting diode chip has been mounted onto the bottom of the cup reflector and then has had its cathode and anode electrodes electrically connected to the leads by way of wires. According to Yano '166, a phosphor is dispersed in the first resin portion so as to be excited with the light A that has been emitted from the light emitting diode chip, the excited phosphor produces fluorescence ("light B") that has a longer wavelength than the light A, a portion of the light A is transmitted through the first resin portion including the phosphor, and as a result, light C, as a mixture of the light A and light B, is used as illumination.

As noted above, "white LED lights" (i.e., lights which are perceived as being white or near-white) have been investigated as potential replacements for white incandescent lamps. A representative example of a white LED lamp includes a package of a blue light emitting diode chip, made of indium gallium nitride (InGaN) or gallium nitride (GaN), coated with a phosphor such as YAG. In such an LED lamp, the blue light emitting diode chip produces an emission with a wavelength of about 450 nm, and the phosphor produces yellow fluorescence with a peak wavelength of about 550 nm on receiving that emission. For instance, in some designs, white light emitting diodes are fabricated by forming a ceramic phosphor layer on the output surface of a blue light-emitting semiconductor light emitting diode. Part of the blue ray emitted from the light emitting diode chip passes through the phosphor, while part of the blue ray emitted from the light emitting diode chip is absorbed by the phosphor, which becomes excited and emits a yellow ray. The part of the blue light emitted by the light emitting diode which is transmitted through the phosphor is mixed with the yellow light emitted by the phosphor. The viewer perceives the mixture of blue and yellow light as white light.

As also noted above, in another type of LED lamp, a light emitting diode chip that emits an ultraviolet ray is combined with phosphor materials that produce red (R), green (G) and blue (B) light rays. In such an "RGB LED lamp", the ultraviolet ray that has been radiated from the light emitting diode chip excites the phosphor, causing the phosphor to emit red, green and blue light rays which, when mixed, are perceived by the human eye as white light. Consequently, white light can also be obtained as a mixture of these light rays.

Designs have been provided in which existing LED component packages and other electronics are assembled into a fixture. In such designs, a packaged LED is mounted to a circuit board or directly to the heat sink, the circuit board is mounted to a heat sink, and the heat sink is mounted to the fixture housing along with required drive electronics. In many cases, additional optics (secondary to the package parts) are also necessary.

In substituting light emitting diodes for other light sources, e.g., incandescent light bulbs, packaged LEDs have been used with conventional light fixtures, for example, fixtures which include a hollow lens and a base plate attached to the lens, the base plate having a conventional socket housing with one or more contacts which are electrically coupled to a power source. For example, LED light bulbs have been constructed which comprise an electrical circuit board, a plurality of packaged LEDs mounted to the circuit board, and a connection post attached to the circuit board and adapted to be connected to the socket housing of the light fixture, whereby the plurality of LEDs can be illuminated by the power source.

There is an ongoing need for ways to use solid state light emitters, e.g., light emitting diodes, to provide white light in a wider variety of applications, with greater energy efficiency, with improved color rendering index (CRI), with improved efficacy (lm/W), low cost, and/or with longer duration of service.

BRIEF SUMMARY OF THE INVENTION

There exist "white" LED light sources which are relatively efficient but which have poor color rendering, typically having CRI Ra values of less than 75, and which are particularity deficient in the rendering of red colors and also to a significant extent deficient in green. This means that many things, including the typical human complexion, food items, labeling, painting, posters, signs, apparel, home decoration, plants, flowers, automobiles, etc. exhibit odd or wrong color as compared to being illuminated with an incandescent light or natural daylight. Typically, such white LED light sources have a color temperature of approximately 5000 K, which is generally not visually comfortable for general illumination, which however may be desirable for the illumination of commercial produce or advertising and printed materials.

Some so-called "warm white" LEDs have a more acceptable color temperature (typically 2700 to 3500 K) for indoor use, and in some special cases, good CRI (in the case of a yellow and red phosphor mix, as high as Ra=95), but their efficiency is generally significantly less than that of the standard "cool white" LEDs.

Aspects related to the present invention can be represented on either the 1931 CIE (Commission International de l'Eclairage) Chromaticity Diagram or the 1976 CIE Chromaticity Diagram. FIG. 1 shows the 1931 CIE Chromaticity Diagram. FIG. 2 shows the 1976 Chromaticity Diagram. FIG. 3 shows an enlarged portion of the 1976 Chromaticity Diagram, in order to show the blackbody locus in more detail. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). For a technical description of CIE chromaticity diagrams, see, for example, "Encyclopedia of Physical Science and Technology", vol. 7, 230-231 (Robert A Meyers ed., 1987). The spectral colors are distributed around the edge of the outlined space, which includes all of the hues perceived by the human eye. The boundary line represents maximum saturation for the spectral colors. As noted above, the 1976 CIE Chromaticity Diagram is similar to the 1931 Diagram, except that the 1976 Diagram has been modified such that similar distances on the Diagram represent similar perceived differences in color.

In the 1931 Diagram, deviation from a point on the Diagram can be expressed either in terms of the coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues which would each be perceived as differing from the specified hue to a common extent (and likewise for loci of points defined as being spaced from a particular hue by other quantities of MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$, and the hues defined by a locus of points which are each a common distance from a specified hue consist of hues which would each be perceived as differing from the specified hue to a common extent.

The chromaticity coordinates and the CIE chromaticity diagrams illustrated in FIGS. 1-3 are explained in detail in a number of books and other publications, such as pages 98-107 of K. H. Butler, "Fluorescent Lamp Phosphors" (The Pennsylvania State University Press 1980) and pages 109-110 of G. Blasse et al., "Luminescent Materials" (Springer-Verlag 1994), both incorporated herein by reference.

The chromaticity coordinates (i.e., color points) that lie along the blackbody locus obey Planck's equation: $E(\lambda)=A\lambda^{-5}/(e^{(B/T)}-1)$, where E is the emission intensity, λ is the emission wavelength, T the color temperature of the blackbody and A and B are constants. Color coordinates that lie on or near the blackbody locus yield pleasing white light to a human observer. The 1976 CIE Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants which produce light which is on or near the blackbody locus can thus be described in terms of their color temperature.

Also depicted on the 1976 CIE Diagram are designations A, B, C, D and E, which refer to light produced by several standard illuminants correspondingly identified as illuminants A, B, C, D and E, respectively.

CRI is a relative measurement of how the color rendition of an illumination system compares to that of a blackbody radiator. The CRI equals 100 if the color coordinates of a set of test colors being illuminated by the illumination system are the same as the coordinates of the same test colors being irradiated by the blackbody radiator.

In accordance with a first aspect of the present invention, there is provided a lighting device, comprising:

a first group of solid state light emitters; and a first group of lumiphors, wherein:

at least some of the first group of solid state light emitters are contained in a first group of packages, each of which also comprises at least one of the first group of lumiphors;

if all of the first group of solid state light emitters which are contained in the first group of packages are illuminated, a combined illumination from the first group of packages would, in the absence of any additional light, have u', v' color coordinates on a 1976 CIE Chromaticity Diagram which define a first point; and if all of the first group of solid state light emitters which are contained in the first group of packages are illuminated, each of at least 20% of the first group of packages would emit light having u', v' color coordinates on a 1976 CIE Chromaticity Diagram which define a point which is spaced from the first point by a distance of not less than 0.10 and not more than 0.30.

In accordance with a second aspect of the present invention, there is provided a lighting device, comprising a first group of packages, each containing at least one solid state light emitter, wherein if each of the at least one solid state light emitter in each of the packages is illuminated, a combined illumination from the first group of packages would, in the absence of any additional light, have u', v' color coordinates on a 1976 CIE Chromaticity Diagram which define a first point; and if each of the at least one solid state light emitter in each of the packages is illuminated, each of at least 20% of the packages would emit light having u', v' color coordinates on a 1976 CIE Chromaticity Diagram which define a point which is spaced from the first point by a distance of not less than 0.10 and not more than 0.30.

In some embodiments according to the second aspect of the present invention, some or all of the packages comprise two or more solid state light emitters and no lumiphors.

As indicated above, the distance referred to in the preceding paragraph can be calculated on 1976 CIE Chromaticity Diagram according to the formula:

$$\text{distance between two points}=(\Delta u'^2+\Delta v'^2)^{1/2},$$

where Δu' is the difference between the u' coordinates for the two points, and where Δv' is the difference between the v' coordinates for the two points.

By providing a lighting device according to the first aspect or the second aspect of the present invention, it is possible to more efficiently adjust the combined illumination from the first group of packages (i.e., to alter its u', v' coordinates by removing (or reinserting) fewer packages), than would be the case where the u', v' coordinates of more of the packages are closer to the u', v' coordinates of the combined illumination, i.e., it is easier to navigate on the u' v' chart (or, of course, on the x, y chart, where the corresponding distances could readily be converted by those skilled in the art).

Additionally, if desired, different groups of the packages can be directly or switchably electrically connected to different power lines, whereby the u', v' coordinates of the combined illumination can be adjusted by adjusting the current through one or more of the power lines, and/or by interrupting current through one or more of the power lines.

Alternatively or additionally, conductive paths can be provided whereby current passed through each of the packages can be independently adjusted, or current passed through any desired combinations of the packages can be independently adjusted In some embodiments of the present invention, there are further provided one or more current adjusters directly or switchably electrically connected to one or more of respective power lines which are electrically connected to solid state light emitters, whereby the current adjuster can be adjusted to adjust the current supplied to the respective solid state light emitter(s).

In some embodiments of the present invention, there are further provided one or more switches electrically connected to one of respective power lines, whereby the switch selectively switches on and off current to the solid state light emitter(s) on the respective power line.

In some embodiments of the present invention, one or more current adjusters and/or one or more switches automatically interrupt and/or adjust current passing through one or more respective power lines in response to a detected change in the output from the lighting device (e.g., an extent of deviation from the blackbody locus) or in accordance with a desired pattern (e.g., based on the time of day or night, such as altering the correlated color temperature of the combined emitted light).

In some embodiments of the present invention, there are further provided one or more thermistors which detect temperature and, as temperature changes, cause one or more current adjusters and/or one or more switches to automatically interrupt and/or adjust current passing through one or more respective power lines in order to compensate for such temperature change. In general, 600 nm to 630 nm light emitting diodes get dimmer as their temperature increases—in such embodiments, fluctuations in intensity caused by such temperature variation can be compensated for.

The solid state light emitters and lumiphors can be arranged in any desired pattern. For example, in some embodiments according to the present invention, some or all of the brighter solid state light emitters are placed closer to a center of the lighting device than the dimmer solid state light emitters.

In accordance with a third aspect of the present invention, there is provided a method of lighting, comprising:

illuminating a first group of solid state light emitters, each of the first group of solid state light emitters being contained in one of a first group of packages, each of which also comprises at least one of a first group of lumiphors, wherein:

a combined illumination from the first group of packages would, in the absence of any additional light, have u', v' color coordinates on a 1976 CIE Chromaticity Diagram which define a first point; and each of at least 20% of the first group of packages emits light having u', v' color coordinates on a 1976 CIE Chromaticity Diagram which define a point which is spaced from the first point by a distance of not less than 0.10 and not more than 0.30.

In accordance with a fourth aspect of the present invention, there is provided a method of lighting, comprising:

illuminating a first group of packages, each of the first group of packages containing at least one solid state light emitter, wherein:

a combined illumination from the first group of packages would, in the absence of any additional light, have u', v' color coordinates on a 1976 CIE Chromaticity Diagram which define a first point; and each of at least 20% of the first group of packages emits light having u', v' color coordinates on a 1976 CIE Chromaticity Diagram which define a point which is spaced from the first point by a distance of not less than 0.10 and not more than 0.30.

In accordance with a fifth aspect of the present invention, there is provided a lighting device, comprising:

a first group of solid state light emitters;

a first group of lumiphors; and at least a first power line, each of the first group of solid state light emitters being electrically connected to the first power line, wherein:

at least some of the first group of solid state light emitters are contained in a first group of packages, each of which also comprises at least one of the first group of lumiphors;

if current is supplied to the first power line:

(1) a combined illumination from the first group of packages would, in the absence of any additional light, have u', v' color coordinates on a 1976 CIE Chromaticity Diagram which define a first point; and (2) each of at least 20% of the first group of packages would emit light having u', v' color coordinates on a 1976 CIE Chromaticity Diagram which define a point which is spaced from the first point by a distance of not less than 0.10 and not more than 0.30.

In accordance with a sixth aspect of the present invention, there is provided a lighting device, comprising:

a first group of solid state light emitters;

a first group of lumiphors; and at least a first power line, the first power line being directly or switchably electrically connected to the lighting device, wherein:

at least some of the first group of solid state light emitters are contained in a first group of packages, each of which also comprises at least one of the first group of lumiphors;

if current is supplied to the first power line:

(1) a combined illumination from the first group of packages would, in the absence of any additional light, have u', v' color coordinates on a 1976 CIE Chromaticity Diagram which define a first point; and (2) each of at least 20% of the first group of packages would emit light having u', v' color coordinates on a 1976 CIE Chromaticity Diagram which define a point which is spaced from the first point by a distance of not less than 0.10 and not more than 0.30.

The solid state light emitters can be saturated or non-saturated. The term "saturated", as used herein, means having a purity of at least 85%, the term "purity" having a well-known meaning to persons skilled in the art, and procedures for calculating purity being well-known to those of skill in the art.

The present invention may be more fully understood with reference to the accompanying drawings and the following detailed description of the invention.

BRIEF DESCRIPTION OF THE DRAWING FIGURES

DETAILED DESCRIPTION OF THE INVENTION

Figure 1:
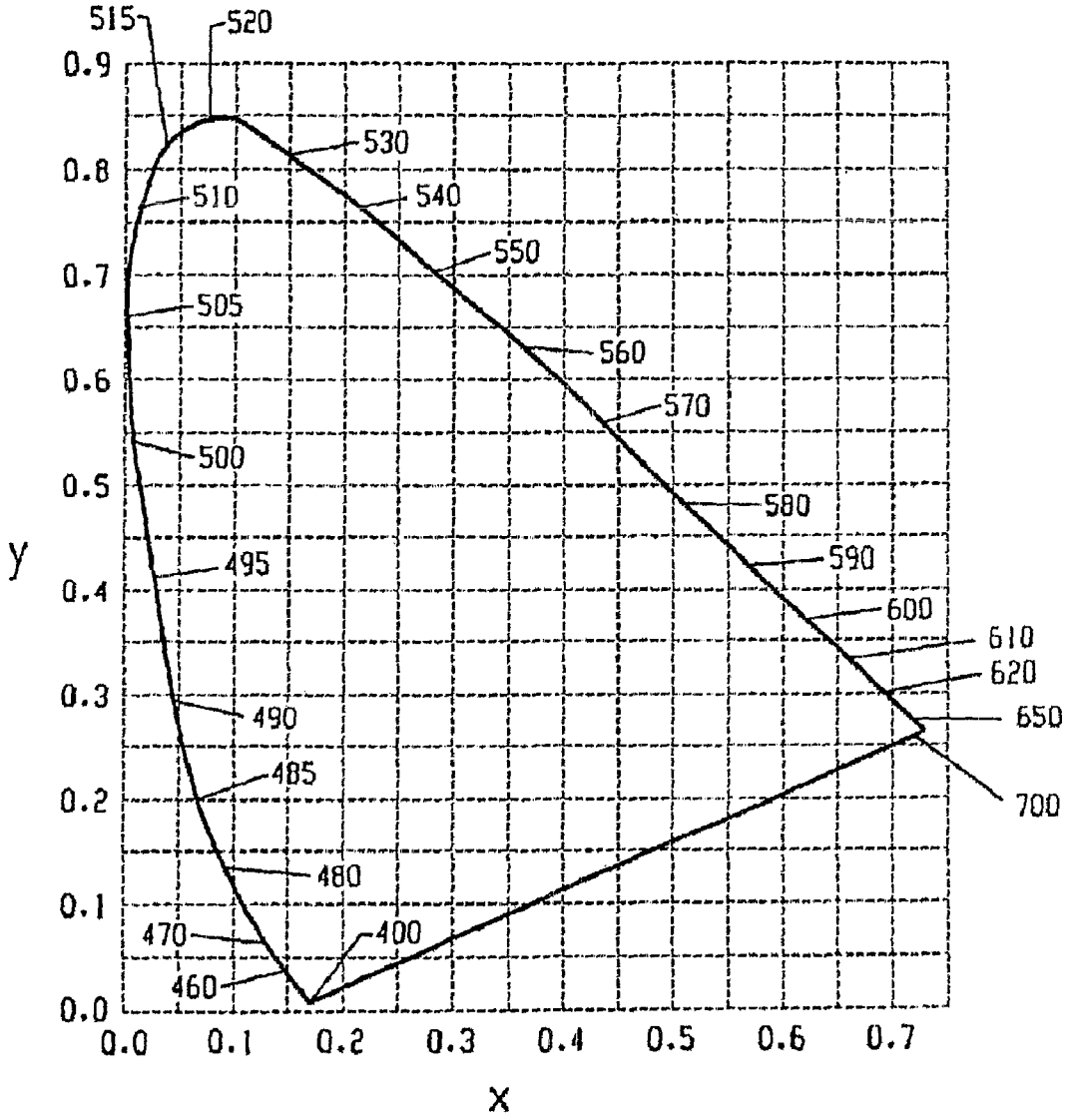
FIG. 1 shows the 1931 CIE Chromaticity Diagram.
Figure 2:
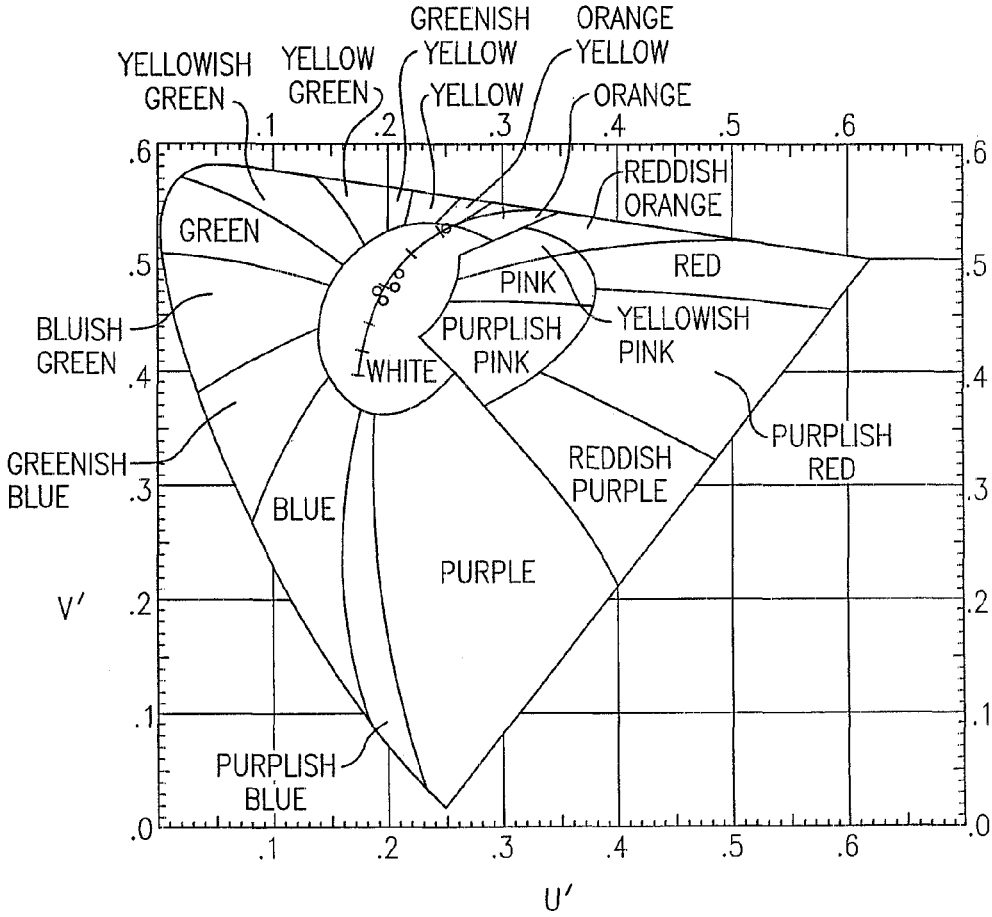
FIG. 2 shows the 1976 Chromaticity Diagram.
Figure 3:
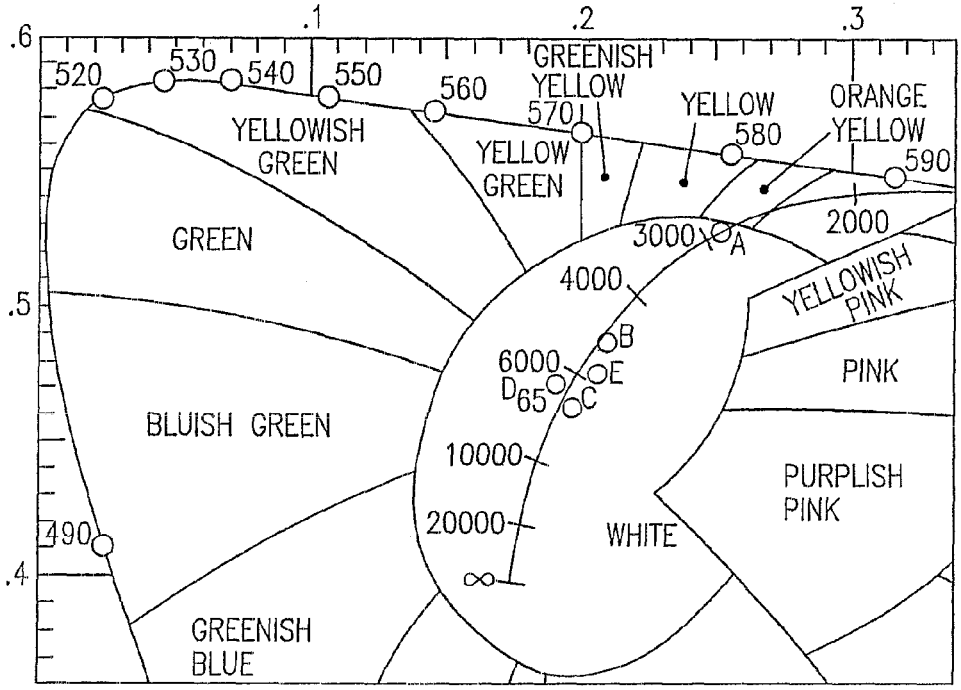
FIG. 3 shows an enlarged portion of the 1976 Chromaticity Diagram, in order to show the blackbody locus in detail.

The expression "directly or switchably electrically connected" means "directly electrically connected" or "switchably electrically connected."

A statement herein that two components in a device are "directly electrically connected," means that there are no components electrically between the components, the insertion of which materially affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected.

A statement herein that two components in a device are "switchably electrically connected" means that there is a switch located between the two components, the switch being selectively closed or opened, wherein if the switch is closed, the two components are directly electrically connected, and if the switch is open (i.e., during any time period that the switch is open), the two components are not electrically connected.

The expression "illuminated", as used herein when referring to a solid state light emitter, means that at least some current is being supplied to the solid state light emitter to cause the solid state light emitter to emit at least some light.

The expression "excited", as used herein when referring to a lumiphor, means that at least some electromagnetic radiation (e.g., visible light, UV light or infrared light) is contacting the lumiphor, causing the lumiphor to emit at least some light.

The solid state light emitter (or solid state light emitters) used in the devices according to the present invention, and the lumiphor (or lumiphors) used in the devices according to the present invention, can be selected from among any solid state light emitters and lumiphors known to persons of skill in the art. Wide varieties of such solid state light emitters and lumiphors are readily obtainable and well known to those of skilled in the art, and any of them can be employed (e.g., AlInGaP for 600 nm to 630 nm light emitting diodes).

Examples of types of such solid state light emitters include inorganic and organic light emitting diodes, a variety of each of which are well-known in the art.

The one or more luminescent materials (if employed) can be any desired luminescent material. The one or more luminescent materials can be down-converting or up-converting, or can include a combination of both types. For example, the one or more luminescent materials can be selected from among phosphors, scintillators, day glow tapes, inks which glow in the visible spectrum upon illumination with ultraviolet light, etc.

The one or more luminescent materials can be provided in any desired form. For example, the luminescent element can be embedded in a resin (i.e., a polymeric matrix), such as a silicone material or an epoxy. Additionally, the luminescent material may be embedded in a substantially transparent glass or metal oxide material.

The one or more lumiphors can individually be any lumiphor, a wide variety of which, as noted above, are known to those skilled in the art. For example, the or each lumiphor can comprise (or can consist essentially of, or can consist of) one or more phosphor. The or each of the one or more lumiphors can, if desired, further comprise (or consist essentially of, or consist of) one or more highly transmissive (e.g., transparent or substantially transparent, or somewhat diffuse) binder, e.g., made of epoxy, silicone, glass or any other suitable material (for example, in any given lumiphor comprising one or more binder, one or more phosphor can be dispersed within the one or more binder). For example, the thicker the lumiphor, in general, the lower the weight percentage of the phosphor can be. Representative examples of the weight percentage of phosphor include from about 3.3 weight percent to about 4.7 weight percent, although, as indicated above, depending on the overall thickness of the lumiphor, the weight percentage of the phosphor could be generally any value, e.g., from 0.1 weight percent to 100 weight percent (e.g., a lumiphor formed by subjecting pure phosphor to a hot isostatic pressing procedure). In some situations, a weight percentage of about 20 weight percent is advantageous.

The or each of the one or more lumiphors can, independently, further comprise any of a number of well-known additives, e.g., diffusers, scatterers, tints, etc.

In some embodiments according to the present invention, the first group of packages comprises at least 5 packages.

In some embodiments according to the present invention, the first group of packages comprises at least 10 packages.

In some embodiments according to the present invention, the first group of packages comprises at least 20 packages.

In some embodiments according to the present invention, the first group of packages comprises at least 50 packages.

In some embodiments according to the present invention, the first group of packages comprises at least 100 packages.

In some embodiments according to the present invention, if all of the first group of solid state light emitters which are contained in the first group of packages are illuminated, each of at least 20% of the first group of packages would emit light having u', v' color coordinates on a 1976 CIE Chromaticity Diagram which define a point which is spaced from the first point by a distance of not less than 0.10 and not more than 0.15.

In some embodiments according to the present invention, if all of the first group of solid state light emitters which are contained in the first group of packages are illuminated, each of at least 40% of the first group of packages would emit light having u', v' color coordinates on a 1976 CIE Chromaticity Diagram which define a point which is spaced from the first point by a distance of not less than 0.10 and not more than 0.15.

In some embodiments according to the present invention, if all of the first group of solid state light emitters which are contained in the first group of packages are illuminated, each of at least 60% of the first group of packages would emit light having u', v' color coordinates on a 1976 CIE Chromaticity Diagram which define a point which is spaced from the first point by a distance of not less than 0.10 and not more than 0.15.

In some embodiments according to the present invention, if all of the first group of solid state light emitters which are contained in the first group of packages are illuminated, each of at least 80% of the first group of packages would emit light having u', v' color coordinates on a 1976 CIE Chromaticity Diagram which define a point which is spaced from the first point by a distance of not less than 0.10 and not more than 0.15.

In some embodiments according to the present invention, if all of the first group of solid state light emitters which are contained in the first group of packages are illuminated, each of at least 20% of the first group of packages would emit light having u', v' color coordinates on a 1976 CIE Chromaticity Diagram which define a point which is spaced from the first point by a distance of not less than 0.10 and not more than 0.20.

In some embodiments according to the present invention, if all of the first group of solid state light emitters which are contained in the first group of packages are illuminated, each of at least 40% of the first group of packages would emit light having u', v' color coordinates on a 1976 CIE Chromaticity Diagram which define a point which is spaced from the first point by a distance of not less than 0.10 and not more than 0.20.

In some embodiments according to the present invention, if all of the first group of solid state light emitters which are contained in the first group of packages are illuminated, each of at least 60% of the first group of packages would emit light having u', v' color coordinates on a 1976 CIE Chromaticity Diagram which define a point which is spaced from the first point by a distance of not less than 0.10 and not more than 0.20.

In some embodiments according to the present invention, if all of the first group of solid state light emitters which are contained in the first group of packages are illuminated, each of at least 80% of the first group of packages would emit light having u', v' color coordinates on a 1976 CIE Chromaticity Diagram which define a point which is spaced from the first point by a distance of not less than 0.10 and not more than 0.20.

In some embodiments according to the present invention, if all of the first group of solid state light emitters which are contained in the first group of packages are illuminated, each of at least 20% of the first group of packages would emit light having u', v' color coordinates on a 1976 CIE Chromaticity Diagram which define a point which is spaced from the first point by a distance of not less than 0.10 and not more than 0.25.

In some embodiments according to the present invention, if all of the first group of solid state light emitters which are contained in the first group of packages are illuminated, each of at least 40% of the first group of packages would emit light having u', v' color coordinates on a 1976 CIE Chromaticity Diagram which define a point which is spaced from the first point by a distance of not less than 0.10 and not more than 0.25.

In some embodiments according to the present invention, if all of the first group of solid state light emitters which are contained in the first group of packages are illuminated, each of at least 60% of the first group of packages would emit light having u', v' color coordinates on a 1976 CIE Chromaticity Diagram which define a point which is spaced from the first point by a distance of not less than 0.10 and not more than 0.25.

In some embodiments according to the present invention, if all of the first group of solid state light emitters which are contained in the first group of packages are illuminated, each of at least 80% of the first group of packages would emit light having u', v' color coordinates on a 1976 CIE Chromaticity Diagram which define a point which is spaced from the first point by a distance of not less than 0.10 and not more than 0.25.

In some embodiments according to the present invention, if all of the first group of solid state light emitters which are contained in the first group of packages are illuminated, each of at least 40% of the first group of packages would emit light having u', v' color coordinates on a 1976 CIE Chromaticity Diagram which define a point which is spaced from the first point by a distance of not less than 0.10 and not more than 0.30.

In some embodiments according to the present invention, if all of the first group of solid state light emitters which are contained in the first group of packages are illuminated, each of at least 60% of the first group of packages would emit light having u', v' color coordinates on a 1976 CIE Chromaticity Diagram which define a point which is spaced from the first point by a distance of not less than 0.10 and not more than 0.30.

In some embodiments according to the present invention, if all of the first group of solid state light emitters which are contained in the first group of packages are illuminated, each of at least 80% of the first group of packages would emit light having u', v' color coordinates on a 1976 CIE Chromaticity Diagram which define a point which is spaced from the first point by a distance of not less than 0.10 and not more than 0.30.

In some lighting devices according to the present invention, there are further included one or more circuitry components, e.g., drive electronics for supplying and controlling current passed through at least one of the one or more solid state light emitters in the lighting device. Persons of skill in the art are familiar with a wide variety of ways to supply and control the current passed through solid state light emitters, and any such ways can be employed in the devices of the present invention. For example, such circuitry can include at least one contact, at least one leadframe, at least one current regulator, at least one power control, at least one voltage control, at least one boost, at least one capacitor and/or at least one bridge rectifier, persons of skill in the art being familiar with such components and being readily able to design appropriate circuitry to meet whatever current flow characteristics are desired.

The present invention further relates to an illuminated enclosure, comprising an enclosed space and at least one lighting device according to the present invention, wherein the lighting device illuminates at least a portion of the enclosure.

The present invention further relates to an illuminated surface, comprising a surface and at least one lighting device according to the present invention, wherein the lighting device illuminates at least a portion of the surface.

The present invention further relates to an illuminated area, comprising at least one area selected from among the group consisting of a swimming pool, a room, a warehouse, an indicator, a road, a vehicle, a road sign, a billboard, a ship, a boat, an aircraft, a stadium, a tree, a window, and a lamppost having mounted therein or thereon at least one lighting device according to the present invention.

Figure 4:
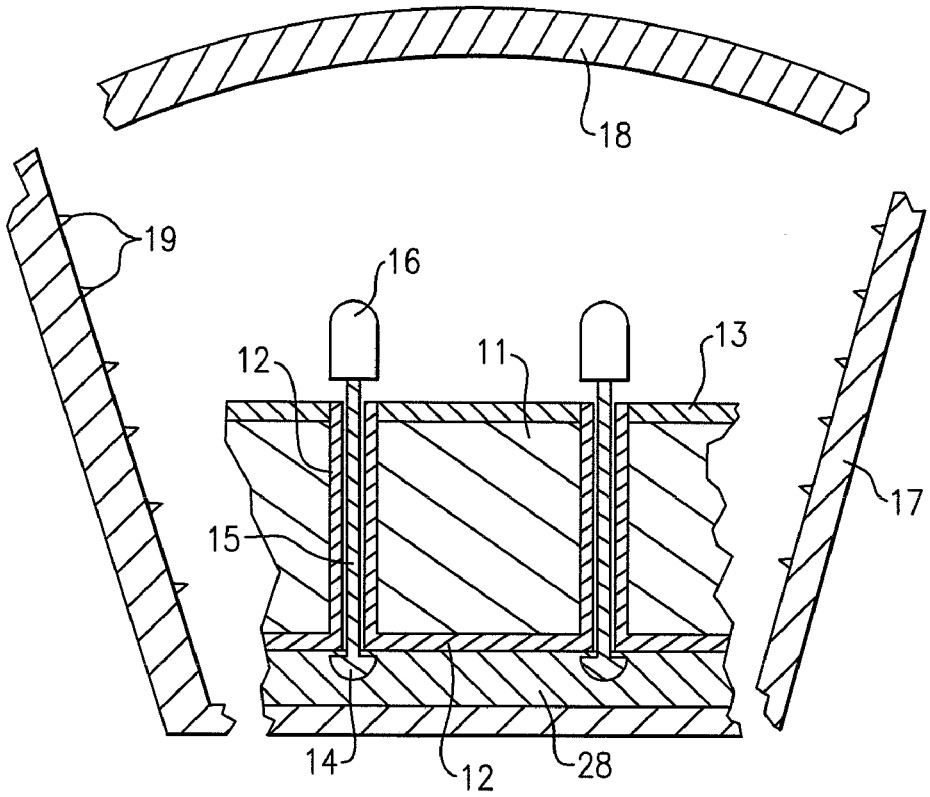
FIG. 4 is a schematic diagram of a representative example of a lighting device in accordance with the present invention.

In addition, persons of skill in the art are familiar with a wide variety of mounting structures for many different types of lighting, and any such structures can be used according to the present invention. For example, FIG. 4 depicts a lighting device which includes a heat spreading element 11 (formed of a material with good heat conducting properties, e.g., aluminum), insulating regions 12 (which can be applied and/or formed in situ, e.g., by anodizing), a highly reflective surface 13 (which can be applied, e.g., McPet, marketed by Furukawa of Japan, laminated aluminum or silver) or formed in situ, e.g., by polishing), conductive traces 14, leadframes 15, packaged LED's 16, a reflective cone 17 and a diffusing element 18. The device depicted in FIG. 4 can further include an insulating element 28 below the conductive traces 14 to avoid unintended contact (e.g., a person receiving a shock) with the conductive traces. The device depicted in FIG. 4 can include any number of packaged LED's (e.g., up to 50 or 100 or more), and so the heat spreading element 11, as well as the insulating regions 12, reflective surface 13 and insulating element 28 can extend any necessary distance to the right or left, in the orientation shown in FIG. 4, as indicated by the fragmented structures (similarly, the sides of the reflective cone 17 can be located any distance to the right or left). Similarly, the diffusing element 18 can be located any desired distance from the LED's 16. The diffusing element 18 can be attached to the reflective cone 17, the insulating element 28, the heat spreading element 11, or any other desired structure in any suitable way, persons of skill in the art being familiar with and readily able to provide such attachment in a wide variety of ways. In this embodiment, and other embodiments, the heat spreading element 11 serves to spread out the heat, act as a heat sink, and/or dissipate the heat. Likewise, the reflective cone 17 functions as a heat sink. In addition, the reflective cone 17 can include ridges 19 to enhance its reflective properties.

Figure 5:
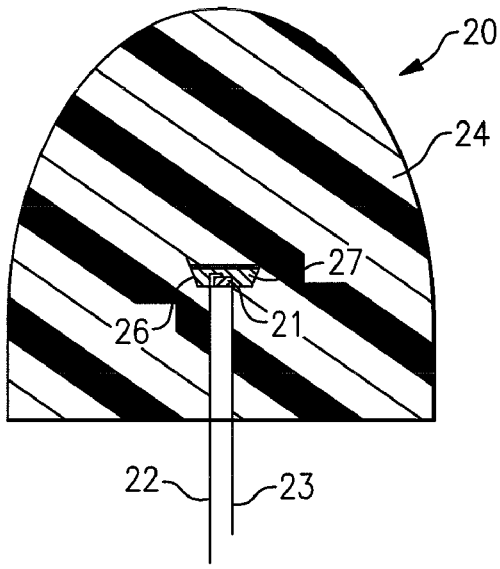
FIG. 5 depicts a representative example of a package which can be used in the devices according to the present invention.

FIG. 5 depicts a representative example of a package which can be used in the devices according to the present invention. Referring to FIG. 5, there is shown a lighting device 20 comprising a solid state light emitter 21 (in this case, a light emitting diode chip 21), a first electrode 22, a second electrode 23, an encapsulant region 24, a reflective element 26 in which the light emitting diode chip 21 is mounted and a lumiphor 27. A packaged device which does not include any lumiphor (e.g., a 600 nm to 630 nm solid state light emitter) can be constructed in a similar way but without the inclusion of a lumiphor 27. Persons of skill in the art are familiar with, and have ready access to, a wide variety of other packaged and unpackaged structures, any of which can, if desired, be employed according to the present invention.

In some embodiments according to the present invention, one or more of the solid state light emitters can be included in a package together with one or more of the lumiphors, and the one or more lumiphor in the package can be spaced from the one or more solid state light emitter in the package to achieve improved light extraction efficiency, as described in U.S. Patent Application No. 60/753,138, filed on Dec. 22, 2005, entitled "Lighting Device" (inventor: Gerald H. Negley), the entirety of which is hereby incorporated by reference.

In some embodiments according to the present invention, two or more lumiphors can be provided, two or more of the lumiphors being spaced from each other, as described in U.S. Patent Application No. 60/761,310, filed on Jan. 23, 2006, entitled "Shifting Spectral Content in LEDs by Spatially Separating Lumiphor Films" (inventors: Gerald H. Negley and Antony Van De Ven), the entirety of which is hereby incorporated by reference.

In some lighting devices according to the present invention, there are further included one or more power sources, e.g., one or more batteries and/or solar cells, and/or one or more standard AC power plugs (i.e., any of a wide variety of plugs which can be received in a standard AC power receptacle, e.g., any of the familiar types of three-pronged power plugs).

The lighting devices according to the present invention can comprise any desired number of LED's and lumiphors. For example, a lighting device according to the present invention can include 50 or more solid state light emitters, or can include 100 or more solid state light emitters, etc. In general, with current light emitting diodes, greater efficiency can be achieved by using a greater number of smaller light emitting diodes (e.g., 100 light emitting diodes each having a surface area of 0.1 $mm^2$ vs. 25 light emitting diodes each having a surface area of 0.4 $mm^2$ but otherwise being identical).

Analogously, light emitting diodes which operate at lower current densities are generally more efficient. Light emitting diodes which draw any particular current can be used according to the present invention. In one aspect of the present invention, light emitting diodes which each draw not more than 50 milliamps are employed.

The sources of visible light in the lighting devices of the present invention can be arranged, mounted and supplied with electricity in any desired manner, and can be mounted on any desired housing or fixture. Skilled artisans are familiar with a wide variety of arrangements, mounting schemes, power supplying apparatuses, housings and fixtures, and any such arrangements, schemes, apparatuses, housings and fixtures can be employed in connection with the present invention. The lighting devices of the present invention can be electrically connected (or selectively connected) to any desired power source, persons of skill in the art being familiar with a variety of such power sources.

Representative examples of arrangements of sources of visible light, schemes for mounting sources of visible light, apparatus for supplying electricity to sources of visible light, housings for sources of visible light, fixtures for sources of visible light and power supplies for sources of visible light, all of which are suitable for the lighting devices of the present invention, are described in U.S. Patent Application No. 60/752,753, filed on Dec. 21, 2005, entitled "Lighting Device" (inventors: Gerald H. Negley, Antony Paul Ven de Ven and Neal Hunter), the entirety of which is hereby incorporated by reference The devices according to the present invention can further comprise one or more long-life cooling device (e.g., a fan with an extremely high lifetime). Such long-life cooling device(s) can comprise piezoelectric or magnetorestrictive materials (e.g., MR, GMR, and/or HMR materials) that move air as a "Chinese fan". In cooling the devices according to the present invention, typically only enough air to break the boundary layer is required to induce temperature drops of 10 to 15 degrees C. Hence, in such cases, strong "breezes" or a large fluid flow rate (large CFM) are typically not required (thereby avoiding the need for conventional fans).

In some embodiments according to the present invention, any of the features, e.g., circuitry, as described in U.S. Patent Application No. 60/761,879, filed on Jan. 25, 2006, entitled "Lighting Device With Cooling" (inventors: Thomas Coleman, Gerald H. Negley and Antony Van De Ven), the entirety of which is hereby incorporated by reference, can be employed.

The devices according to the present invention can further comprise secondary optics to further change the projected nature of the emitted light. Such secondary optics are well-known to those skilled in the art, and so they do not need to be described in detail herein—any such secondary optics can, if desired, be employed.

The devices according to the present invention can further comprise sensors or charging devices or cameras, etc. For example, persons of skill in the art are familiar with, and have ready access to, devices which detect one or more occurrence (e.g., motion detectors, which detect motion of an object or person), and which, in response to such detection, trigger illumination of a light, activation of a security camera, etc. As a representative example, a device according to the present invention can include a lighting device according to the present invention and a motion sensor, and can be constructed such that (1) while the light is illuminated, if the motion sensor detects movement, a security camera is activated to record visual data at or around the location of the detected motion, or (2) if the motion sensor detects movement, the light is illuminated to light the region near the location of the detected motion and the security camera is activated to record visual data at or around the location of the detected motion, etc.

For indoor residential illumination a color temperature of 2700 k to 3300 k is normally preferred, and for outdoor flood lighting of colorful scenes a color temperature approximating daylight 5000K (4500-6500K) is preferred.

Any two or more structural parts of the lighting devices described herein can be integrated. Any structural part of the lighting devices described herein can be provided in two or more parts (which can be held together, if necessary).

The invention claimed is:

1. A lighting device, comprising:

a first group of solid state light emitters; and at least a first luminescent material, wherein:

at least some of said first group of solid state light emitters are in a first group of packages, each of which also comprises at least some of said first luminescent material;

if said first group of solid state light emitters which are in said first group of packages are illuminated, a combined illumination from said first group of packages would, in the absence of any additional light, have u', v' color coordinates on a 1976 CIE, Chromaticity Diagram which define a first point; and if said first group of solid state light emitters which are in said first group of packages are illuminated, at least 20% of said first group of packages would emit light having u', v' color coordinates on a 1976 CIE Chromaticity Diagram which define respective points which are each spaced from said first point by a distance of not less than 0.10 and not more than 0.30.

2. A lighting device as recited in claim 1, wherein said first group of packages comprises at least 5 packages.

3. A lighting device as recited in claim 1, wherein said first group of packages comprises at least 10 packages.

4. A lighting device as recited in claim 1, wherein said first group of packages comprises at least 20 packages.

5. A lighting device as recited in claim 1, wherein said first group of packages comprises at least 50 packages.

6. A lighting device as recited in claim 1, wherein said first group of packages comprises at least 100 packages.

7. A lighting device as recited in claim 1, wherein if all of said first group of solid state light emitters which are in said first group of packages are illuminated, each of at least 40% of said first group of packages would emit light having u', v' color coordinates on a 1976 CIE Chromaticity Diagram which define a point which is spaced from said first point by a distance of not less than 0.10 and not more than 0.15.

8. A lighting device as recited in claim 1, wherein if all of said first group of solid state light emitters which are in said first group of packages are illuminated, each of at least 60% of said first group of packages would emit light having u', v' color coordinates on a 1976 CIE Chromaticity Diagram which define a point which is spaced from said first point by a distance of not less than 0.10 and not more than 0.15.

9. A lighting device as recited in claim 1, wherein if all of said first group of solid state light emitters which are in said first group of packages are illuminated, each of at least 80% of said first group of packages would emit light having u', v' color coordinates on a 1976 CIE Chromaticity Diagram which define a point which is spaced from said first point by a distance of not less than 0.10 and not more than 0.15.

10. A lighting device as recited in claim 1, wherein if all of said first group of solid state light emitters which are in said first group of packages are illuminated, each of at least 20% of said first group of packages would emit light having u', v' color coordinates on a 1976 CIE Chromaticity Diagram which define a point which is spaced from said first point by a distance of not less than 0.10 and not more than 0.20.

11. A lighting device as recited in claim 1, wherein if all of said first group of solid state light emitters which are in said first group of packages are illuminated, each of at least 40% of said first group of packages would emit light having u', v' color coordinates on a 1976 CIE Chromaticity Diagram which define a point which is spaced from said first point by a distance of not less than 0.10 and not more than 0.20.

12. A lighting device as recited in claim 1, wherein if all of said first group of solid state light emitters which are in said first group of packages are illuminated, each of at least 60% of said first group of packages would emit light having u', v' color coordinates on a 1976 CIE Chromaticity Diagram which define a point which is spaced from said first point by a distance of not less than 0.10 and not more than 0.20.

13. A lighting device as recited in claim 1, wherein if all of said first group of solid state light emitters which are in said first group of packages are illuminated, each of at least 80% of said first group of packages would emit light having u', v' color coordinates on a 1976 CIE Chromaticity Diagram which define a point which is spaced from said first point by a distance of not less than 0.10 and not more than 0.20.

14. A lighting device as recited in claim 1, wherein if all of said first group of solid state light emitters which are in said first group of packages are illuminated, each of at least 20% of said first group of packages would emit light having u', v' color coordinates on a 1976 CIE Chromaticity Diagram which define a point which is spaced from said first point by a distance of not less than 0.10 and not more than 0.25.

15. A lighting device as recited in claim 1, wherein if all of said first group of solid state light emitters which are in said first group of packages are illuminated, each of at least 40% of said first group of packages would emit light having u', v' color coordinates on a 1976 CIR Chromaticity Diagram which define a point which is spaced from said first point by a distance of not less than 0.10 and not more than 0.25.

16. A lighting device as recited in claim 1, wherein if all of said first group of solid state light emitters which are in said first group of packages are illuminated, each of at least 60% of said first group of packages would emit light having u', v' color coordinates on a 1976 CIE Chromaticity Diagram which define a point which is spaced from said first point by a distance of not less than 0.10 and not more than 0.25.

17. A lighting device as recited in claim 1, wherein if all of said first group of solid state light emitters which are in said first group of packages are illuminated, each of at least 80% of said first group of packages would emit light having u', v' color coordinates on a 1976 CIE Chromaticity Diagram which define a point which is spaced from said first point by a distance of not less than 0.10 and not more than 0.25.

18. A lighting device as recited in claim 1, wherein if all of said first group of solid state light emitters which are in said first group of packages are illuminated, each of at least 20% of said first group of packages would emit light having u', v' color coordinates on a 1976 CIE Chromaticity Diagram which define a point which is spaced from said first point by a distance of not less than 0.10 and not more than 0.15.

19. A lighting device as recited in claim 1, wherein if all of said first group of solid state light emitters which are in said first group of packages are illuminated, each of at least 40% of said first group of packages would emit light having u', v' color coordinates on a 1976 CIE Chromaticity Diagram which define a point which is spaced from said first point by a distance of not less than 0.10 and not more than 0.30.

20. A lighting device as recited in claim 1, wherein if all of said first group of solid state light emitters which are in said first group of packages are illuminated, each of at least 60% of said first group of packages would emit light having u', v' color coordinates on a 1976 CIE Chromaticity Diagram which define a point which is spaced from said first point by a distance of not less than 0.10 and not more than 0.30.

21. A lighting device as recited in claim 1, wherein if all of said first group of solid state light emitters which are in said first group of packages are illuminated, each of at least 80% of said first group of packages would emit light having u', v' color coordinates on a 1976 CIE Chromaticity Diagram which define a point which is spaced from said first point by a distance of not less than 0.10 and not more than 0.30.

22. A method of lighting, comprising:

illuminating a first group of solid state light emitters, each of said first group of solid state light emitters in one of a first group of packages, each of which also comprises at least a first luminescent material, wherein:

a combined illumination from said first group of packages would, in the absence of any additional light, have u', v' color coordinates on a 1976 CIE Chromaticity Diagram which define a first point; and at least 20% of said first group of packages emit light having u', v' color coordinates on a 1976 CIE Chromaticity Diagram which define respective points which are spaced from said first point by a distance of not less than 0.10 and not more than 0.30.

23. A method as recited in claim 22, wherein said first group of packages comprises at least 5 packages.

24. A method as recited in claim 22, wherein said first group of packages comprises at least 10 packages.

25. A method as recited in claim 22, wherein said first group of packages comprises at least 20 packages.

26. A method as recited in claim 22, wherein said first group of packages comprises at least 50 packages.

27. A method as recited in claim 22, wherein said first group of packages comprises at least 100 packages.

28. A method as recited in claim 22, wherein each of at least 40% of said first group of packages emits light having u', v' color coordinates on a 1976 CIE Chromaticity Diagram which define a point which is spaced from said first point by a distance of not less than 0.10 and not more than 0.15.

29. A method as recited in claim 22, wherein each of at least 60% of said first group of packages emits light having u', v' color coordinates on a 1976 CIE Chromaticity Diagram which define a point which is spaced from said first point by a distance of not less than 0.10 and not more than 0.15.

30. A method as recited in claim 22, wherein each of at least 80% of said first group of packages emits light having u', v' color coordinates on a 1976 CIE Chromaticity Diagram which define a point which is spaced from said first point by a distance of not less than 0.10 and not more than 0.15.

31. A method as recited in claim 22, wherein each of at least 20% of said first group of packages emits light having u', v' color coordinates on a 1976 CIE Chromaticity Diagram which define a point which is spaced from said first point by a distance of not less than 0.10 and not more than 0.20.

32. A method as recited in claim 22, wherein each of at least 40% of said first group of packages emits light having u', v' color coordinates on a 1976 CIE Chromaticity Diagram which define a point which is spaced from said first point by a distance of not less than 0.10 and not more than 0.20.

33. A method as recited in claim 22, wherein each of at least 60% of said first group of packages emits light having u', v' color coordinates on a 1976 CIE Chromaticity Diagram which define a point which is spaced from said first point by a distance of not less than 0.10 and not more than 0.20.

34. A method as recited in claim 22, wherein each of at least 80% of said first group of packages emits light having u', v' color coordinates on a 1976 CIE Chromaticity Diagram which define a point which is spaced from said first point by a distance of not less than 0.10 and not more than 0.20.

35. A method as recited in claim 22, wherein each of at least 20% of said first group of packages emits light having u', v' color coordinates on a 1976 CIE Chromaticity Diagram which define a point which is spaced from said first point by a distance of not less than 0.10 and not more than 0.25.

36. A method as recited in claim 22, wherein each of at least 40% of said first group of packages emits light having u', v' color coordinates on a 1976 CIE Chromaticity Diagram which define a point which is spaced from said first point by a distance of not less than 0.10 and not more than 0.25.

37. A method as recited in claim 22, wherein each of at least 60% of said first group of packages emits light having u', v' color coordinates on a 1976 CIE Chromaticity Diagram which define a point which is spaced from said first point by a distance of not less than 0.10 and not more than 0.25.

38. A method as recited in claim 22, wherein each of at least 80% of said first group of packages emits light having u', v' color coordinates on a 1976 CIE Chromaticity Diagram which define a point which is spaced from said first point by a distance of not less than 0.10 and not more than 0.25.

39. A method as recited in claim 22, wherein each of at least 20% of said first group of packages emits light having u', v' color coordinates on a 1976 CIE Chromaticity Diagram which define a point which is spaced from said first point by a distance of not less than 0.10 and not more than 0.15.

40. A method as recited in claim 22, wherein each of at least 40% of said first group of packages emits light having u', v' color coordinates on a 1976 CIE Chromaticity Diagram which define a point which is spaced from said first point by a distance of not less than 0.10 and not more than 0.30.

41. A method as recited in claim 22, wherein each of at least 60% of said first group of packages emits light having u', v' color coordinates on a 1976 CIE Chromaticity Diagram which define a point which is spaced from said first point by a distance of not less than 0.10 and not more than 0.30.

42. A method as recited in claim 22, wherein each of at least 80% of said first group of packages emits light having u', v' color coordinates on a 1976 CIE Chromaticity Diagram which define a point which is spaced from said first point by a distance of not less than 0.10 and not more than 0.30.

43. A lighting device, comprising:

a first group of packages, each of said packages containing at least one solid state light emitter, wherein if each of said at least one solid state light emitter in each of said packages is illuminated, a combined illumination from said first group of packages would, in the absence of any additional light, have u', v' color coordinates on a 1976 CIE Chromaticity Diagram which define a first point; and if each of said at least one solid state light emitter in each of said packages is illuminated, at least 20% of said packages would emit light having u', v' color coordinates on a 1976 CIE Chromaticity Diagram which define respective points which are spaced from said first point by a distance of not less than 0.10 and not more than 0.30.

44. A lighting device as recited in claim 43, wherein at least some of said packages comprise two or more solid state light emitters.

45. A method of lighting, comprising:

illuminating a first group of packages, each of said first group of packages containing at least one solid state light emitter, wherein:

a combined illumination from said first group of packages would, in the absence of any additional light, have u', v' color coordinates on a 1976 CIE Chromaticity Diagram which define a first point; and at least 20% of said first group of packages emit light having u', v' color coordinates on a 1976 CIE Chromaticity Diagram which define respective points which are spaced from said first point by a distance of not less than 0.10 and not more than 0.30.

46. A method as recited in claim 45, wherein at least some of said packages comprise two or more solid state light emitters.

47. A lighting device, comprising:

a first group of solid state light emitters;

at least a first luminescent material; and at least a first power line, each of said first group of solid state light emitters electrically connected to said first power line, wherein:

at least some of said first group of solid state light emitters are in a first group of packages, each of which also comprises at least some of said first luminescent material;

if current is supplied to said first power line:

(1) a combined illumination from said first group of packages would, in the absence of any additional light, have u', v' color coordinates on a 1976 CIE Chromaticity Diagram which define a first point; and (2) at least 20% of said first group of packages would emit light having u', v' color coordinates on a 1976 CIE Chromaticity Diagram which define respective points which are spaced from said first point by a distance of not less than 0.10 and not more than 0.30.

48. A lighting device, comprising:

a first group of solid state light emitters;

at least a first luminescent material; and at least a first power line, said first power line directly or switchably electrically connected to said lighting device, wherein:

at least some of said first group of solid state light emitters are in a first group of packages, each of which also comprises at least some of said first luminescent material;

if current is supplied to said first power line:

(1) a combined illumination from said first group of packages would, in the absence of any additional light, have u', v' color coordinates on a 1976 CIE Chromaticity Diagram which define a first point; and (2) at least 20% of said first group of packages would emit light having u', v' color coordinates on a 1976 CIE Chromaticity Diagram which define respective points which are spaced from said first point by a distance of not less than 0.10 and not more than 0.30.

49. A lighting device as recited in claim 1, wherein said first luminescent material in at least some of said first group of packages is dispersed in at least one binder.

50. A method as recited in claim 22, wherein said first luminescent material in at least some of said first group of packages is dispersed in at least one binder.

51. A lighting device as recited in claim 47, wherein said first luminescent material in at least some of said first group of packages is dispersed in at least one binder.

52. A lighting device as recited in claim 48, wherein said first luminescent material in at least some of said first group of packages is dispersed in at least one binder.

53. A lighting device, comprising:

a first group of solid state light emitters; and at least a first luminescent material, wherein:

if the first group of solid state light emitters is illuminated, a combined illumination comprising (1) light emitted by the first group of solid state light emitters which exits the lighting device without being converted by the first luminescent material and (2) light emitted by the first group of solid state light emitters which exits the lighting device after being converted by the first luminescent material would, in the absence of any additional light, have u', v' color coordinates on a 1976 CIE Chromaticity Diagram which define a first point; and if the first group of solid state light emitters is illuminated, for each of at least 20% of the first group of solid state light emitters, a combination of (1) light emitted by the solid state light emitter which exits the lighting device without being converted by the first luminescent material and (2) light emitted by the solid state light emitter which exits the lighting device after being converted by the first luminescent material would have u', v' color coordinates on a 1976 CIE Chromaticity Diagram which define a point which is spaced from the first point by a distance of not less than 0.10 and not more than 0.30.

* * * * *